US008678556B2

(12) United States Patent
Iwanaga et al.

(10) Patent No.: US 8,678,556 B2
(45) Date of Patent: Mar. 25, 2014

(54) LIQUID DISCHARGE RECORDING HEAD AND METHOD OF MANUFACTURING THE SAME

(75) Inventors: Shuzo Iwanaga, Kawasaki (JP); Shogo Kawamura, Numazu (JP); Yasuhiko Osaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/262,946

(22) PCT Filed: May 26, 2010

(86) PCT No.: PCT/JP2010/059289

§ 371 (c)(1),
(2), (4) Date: Oct. 5, 2011

(87) PCT Pub. No.: WO2010/143565

PCT Pub. Date: Dec. 16, 2010

(65) Prior Publication Data

US 2012/0033017 A1 Feb. 9, 2012

(30) Foreign Application Priority Data

Jun. 9, 2009 (JP) ..... 2009-138185

(51) Int. Cl.

| | |
|---|---|
| ***B41J 2/05*** | (2006.01) |
| ***B41J 2/14*** | (2006.01) |
| ***B41J 2/04*** | (2006.01) |
| ***B21D 53/76*** | (2006.01) |

(52) U.S. Cl.

USPC ..... 347/58; 347/50; 347/54; 29/890.1

(58) Field of Classification Search

None

See application file for complete search history.

(56) References Cited

U.S. PATENT DOCUMENTS 2,940,161 A * 6/1960 Elarde ..... 29/25.42
6,132,032 A * 10/2000 Bryant et al. ..... 347/59
6,257,703 B1 7/2001 Hirosawa et al.

(Continued)

FOREIGN PATENT DOCUMENTS

CN 101204878 A 6/2008
JP 08-336975 * 12/1996 ..... B41J 2/05

(Continued)

OTHER PUBLICATIONS

International Preliminary Report on Patentability, International Application No. PCT/JP2010/059289, filed on May 26, 2010.

(Continued)

*Primary Examiner* — Geoffrey Mruk

(74) *Attorney, Agent, or Firm* — Fitzpatrick, Cella, Harper & Scinto

(57) ABSTRACT

A liquid discharge recording head includes: a recording element substrate, an electric wiring board, and a supporting plate that supports the recording element substrate and the electric wiring board, with a gap formed between the recording element substrate and the electric wiring board, and a connecting member that electrically connects, across the gap, an electrode provided in the recording element substrate and an electrode terminal provided in the electric wiring board. A first resin agent that is filled in the gap, a second resin agent seals the electrode, the electrode terminal, and the connecting member, and a third resin agent that is provided between the first resin agent and the supporting plate and has a lower modulus of elasticity than the first resin agent and the second resin agent.

10 Claims, 7 Drawing Sheets

(56) References Cited

U.S. PATENT DOCUMENTS

| | | | | |
|---|---|---|---|---|
| 6,536,868 | B1 | 3/2003 | Kawamura et al. | |
| 6,652,702 | B2 | 11/2003 | Miyazaki et al. | |
| 6,834,937 | B2 * | 12/2004 | Spivey et al. | 347/50 |
| 6,877,839 | B2 | 4/2005 | Kawamura et al. | |
| 6,910,759 | B2 | 6/2005 | Kawamura et al. | |
| 7,547,094 | B2 | 6/2009 | Kawamura et al. | |
| 7,690,767 | B2 | 4/2010 | Hirosawa et al. | |
| 7,775,638 | B2 | 8/2010 | Hirosawa et al. | |
| 7,789,499 | B2 | 9/2010 | Iwanaga et al. | |
| 7,980,676 | B2 | 7/2011 | Hirosawa et al. | |
| 2008/0143784 | A1 | 6/2008 | Ono | |
| 2009/0009559 | A1 | 1/2009 | Jindai et al. | |

FOREIGN PATENT DOCUMENTS

| | | | |
|---|---|---|---|
| JP | 8-336975 | A | 12/1996 |
| JP | 3592208 | B2 | 11/2004 |
| JP | 2007-296638 | A | 11/2007 |
| JP | 2008-62463 | A | 3/2008 |

OTHER PUBLICATIONS

Notification of the First Office Action dated Dec. 16, 2013, in Chinese Application No. 201080024858.1.

* cited by examiner

LIQUID DISCHARGE RECORDING HEAD AND METHOD OF MANUFACTURING THE SAME

TECHNICAL FIELD

The present invention relates to a liquid discharge recording head that discharges a liquid such as ink, and a method of manufacturing the liquid discharge recording head.

BACKGROUND ART

A liquid discharge recording head is mounted in a liquid discharge recording apparatus that performs recording by discharging a liquid such as ink. The available kinds of liquid discharge recording heads include a liquid discharge recording head that uses an electricity-heat transducing element as a recording element that generates energy that discharges a liquid. When an electric control signal for recording is sent to the electricity-heat transducing element, electrical energy is converted into heat energy to generate heat. The electricity-heat transducing element is disposed in the vicinity of a discharge port of the liquid discharge recording head. The discharge port is an opening that discharges a liquid. A liquid in the vicinity of the electricity-heat transducing element is instantaneously heated by the heat energy that is generated by the electricity-heat transducing element. At this time, as the result of bubble pressure that is generated by boiling of the liquid, a liquid in the vicinity of the discharge port is discharged from the discharge port. Thus, the liquid discharge recording apparatus causes liquid to adhere to a recording medium that is arranged facing the discharge port to thereby perform recording on the recording medium.

One example of the above described liquid discharge recording head is disclosed in Japanese Patent No. 3,592,208. FIG. 9 is a perspective view of a recording element unit included in a liquid discharge recording head described in Japanese Patent No. 3,592,208. FIG. 10 is a sectional view of the recording element unit along a line X-X in FIG. 9. FIG. 11 is a sectional view of the recording element unit along a line XI-XI in FIG. 9.

The recording element unit includes a recording element substrate 1 that has a discharge energy generating element (recording element) 4 that generates energy that discharges a liquid, and a flexible wiring board 11. The recording element substrate 1 is fixedly supported by a supporting member 8, and is provided with discharge ports 6 that discharge a liquid. The flexible wiring board 11 is mounted to the supporting member 8 via a supporting board 9.

The flexible wiring board 11 and the supporting board 9 have an opening part. The recording element substrate 1 is integrated into the opening part. An electrode 7 is formed in the recording element substrate 1. A stud bump 14 is provided on the electrode 7. An electrode lead 13 that is electrically connected to the electrode 7 of the recording element substrate 1 is provided in the flexible wiring board 11. A recess 17 is formed between the recording element substrate 1 and the flexible wiring board 11 and supporting board 9. A first sealing resin 18 that has elasticity after curing is filled in the recess 17. Electrically connecting parts between the recording element substrate 1 and the flexible wiring board 11 (that is, the electrode 7, the stud bump 14, and the electrode lead 13) are covered by the first and second sealing resins 18 and 19. It is thereby possible to prevent an electrical connection fault that occurs due to one of the electrically connecting parts, for example, coming into contact with a liquid such as ink or being subjected to an external impact. Since the first sealing resin 18 has elasticity after curing, cracks in the recording element substrate 1 at the time of curing are suppressed and the electrically connecting parts are also protected from an external force.

Recently, full-line type recording heads in which a plurality of recording element substrates are arranged on a supporting member are also being constructed to execute high-speed recording. According to one example of a full-line type liquid discharge recording head, recording element substrates are aligned in two rows along a direction in which discharge ports formed in the recording element substrates are aligned. By lengthening the liquid discharge recording head in this manner, it is possible to support recording onto a large-sized recording medium.

A recording element substrate in which discharge ports are formed must be mounted with precision on a supporting member. Particularly in the case of a liquid discharge recording head that includes recording element substrates that have a long shape, it is necessary to mount the recording element substrates with a high level of accuracy, and if the mounting positions are misaligned, stripes or unevenness arise in an image that is recorded by the discharged liquid.

According to Japanese Patent No. 3,592,208, electrically connecting parts between the recording element substrate 1 and the flexible wiring board 11 are sealed with the first sealing resin 18 that has elasticity after curing and the second sealing resin 19 that has an extremely high degree of hardness after curing. However, referring to FIG. 10, it can be seen that one part of the first sealing resin 18 is exposed at the surface. There is thus the problem that if the first sealing resin 18 has a low modulus of elasticity, the first sealing resin 18 weakens with respect to an external force and the durability of the liquid discharge recording head decreases.

Further, there is a tendency for the adhesiveness between two kinds of sealing resins that have a different modulus of elasticity or linear expansivity to each other to be weak. This is because when two kinds of sealing resins have a different modulus of elasticity or linear expansivity to each other, the sealing resins are affected by each other's force when a temperature change occurs. Accordingly, if the adhesion between the first sealing resin 18 and the second sealing resin 19 decreases, there is the risk that liquid will enter at the boundary surface between the sealing resins 18 and 19, and the liquid will reach an electrically connecting part. Consequently, the durability of the liquid discharge recording head will decrease.

The full-line type liquid discharge recording head is often used for business purposes or industrial purposes, and the cost of the liquid discharge recording head is high. Therefore, since it is important for a full-line type liquid discharge head to have a high level of durability, it is desirable to solve the above problem in particular.

One method that may be considered in order to increase the adhesiveness between two kinds of sealing resins is to use two kinds of sealing resins for which the modulus of elasticity or linear expansivity are the same level. However, in the liquid discharge recording head described in Japanese Patent No. 3,592,208, when the first sealing resin 18 and the second sealing resin 19 are formed from material that have values of the same level with respect to the modulus of elasticity or linear expansivity, there is the possibility that a new problem will arise. The new problem is described below.

When the modulus of elasticity of both the first and second sealing resins 18 and 19 is low, the sealing resins 18 and 19 are weakened with respect to an external force. Therefore, if an external force is applied to the sealing resins 18 and 19 by wiping or a paper jam or the like, a failure may occur at the electrically connecting parts that are sealed by the sealing resins 18 and 19.

When the modulus of elasticity of both the first sealing resin 18 and the second sealing resin 19 is high, a different problem arises. Even when the modulus of elasticity of both the first and second sealing resins 18 and 19 is high, if there is a difference between the linear expansivity of the recording element substrate 1 and the linear expansivity of the supporting member 8, a difference arises in the deformation amount of the recording element substrate 1 and the supporting member 8. The first sealing resin 18 is adhered to the supporting member 8 and is formed around the circumference of the recording element substrate 1. Hence, when the supporting member 8 expands or contracts, the first sealing resin 18 adhered to the supporting member 8 applies a force to the recording element substrate 1. The recording element substrate 1 is warped by the force. In particular, when the supporting member 8 changes shape in the direction of contraction, the first sealing resin 18 applies a force in a direction that causes the recording element substrate 1 to contract, and as a result the recording element substrate 1 becomes warped.

A large change in temperature occurs when the sealing resins 18 and 19 are subjected to thermal curing. In particular, the first sealing resin 18 around the circumference of the recording element substrate 1 cures when the sealing resins 18 and 19 are heated. Thereafter, when the sealing resins 18 and 19 are cooled to ambient temperature, the recording element substrate 1 is warped by a force received from the sealing resin 18. In this case, the recording element substrate 1 maintains the warped state under ambient temperature. When the recording element substrate 1 warps, there is the risk that the positions of discharge ports 6 formed in the recording element substrate 1 will be misaligned and result in a decline in the printing quality.

If the recording element substrate 1 is long in the direction in which discharge ports are aligned, a difference in a deformation amount of the recording element substrate 1 and a deformation amount of the supporting member 8 increases further, and warping of the recording element substrate 1 also increases in accordance with the difference in the deformation amounts. As a result, not only does the printing quality decline, but there is also the possibility that the recording element substrate 1 will come unstuck from the supporting member 8 or that the recording element substrate 1 will break.

DISCLOSURE OF THE INVENTION

An object of the present invention is to provide a liquid discharge recording head that provides highly reliable connections between electrical connecting parts and suppresses a decline in printing quality.

To achieve the above object, a liquid discharge recording head of the present invention includes: a recording element substrate that has a recording element that generates energy for discharging a liquid, an electric wiring board that is electrically connected with the recording element of the recording element substrate and having an opening part formed therein, and a supporting plate that supports the recording element substrate and the electric wiring board, wherein the recording element substrate is arranged at the opening part of the electric wiring board such that a gap is formed between the recording element substrate and the electric wiring board; the liquid discharge recording head further including: a connecting member that electrically connects, across the gap, an electrode provided in the recording element substrate and an electrode terminal provided in the electric wiring board; and a first resin agent that is filled in the gap between the recording element substrate and the electric wiring board, a second resin agent that seals the electrode of the recording element substrate, the electrode terminal of the electric wiring board, and the connecting member, and contacts with a surface that is on an opposite side to the supporting plate of the first resin agent, and a third resin agent that is provided between the first resin agent and the supporting plate and that has a lower modulus of elasticity than the first resin agent and the second resin agent.

A method of manufacturing a liquid discharge recording head of the present invention includes: preparing a recording element substrate that has a recording element that generates energy for discharging a liquid, an electric wiring board having an opening part formed therein, a supporting plate that supports the recording element substrate and the electric wiring board, a first resin agent, a second resin agent, and a third resin agent that has a lower modulus of elasticity than the first resin agent and the second resin agent; joining the recording element substrate to the supporting plate; forming the third resin agent on the supporting plate; aligning the opening part of the electric wiring board and the recording element substrate so that a gap is formed between the recording element substrate and the electric wiring board, and joining the electric wiring board to the supporting plate; electrically connecting, across the gap, an electrode provided in the recording element substrate and an electrode terminal provided in the electric wiring board by means of a connecting member; filling the first resin agent into the gap between the recording element substrate and the electric wiring board; and sealing the electrode of the recording element substrate, the electrode terminal of the electric wiring board, and the connecting member with the second resin agent so that the second resin agent contacts with the first resin agent.

According to the present invention, a liquid discharge recording head that provides highly reliable connections between electrical connecting parts and suppresses a decline in printing quality can be provided.

Further features of the present invention will become apparent from the following description of exemplary embodiments with reference to the attached drawings.

BEST MODE FOR CARRYING OUT THE INVENTION

Embodiments of the present invention are described below with reference to the drawings.

(First Embodiment)

Figure 1:
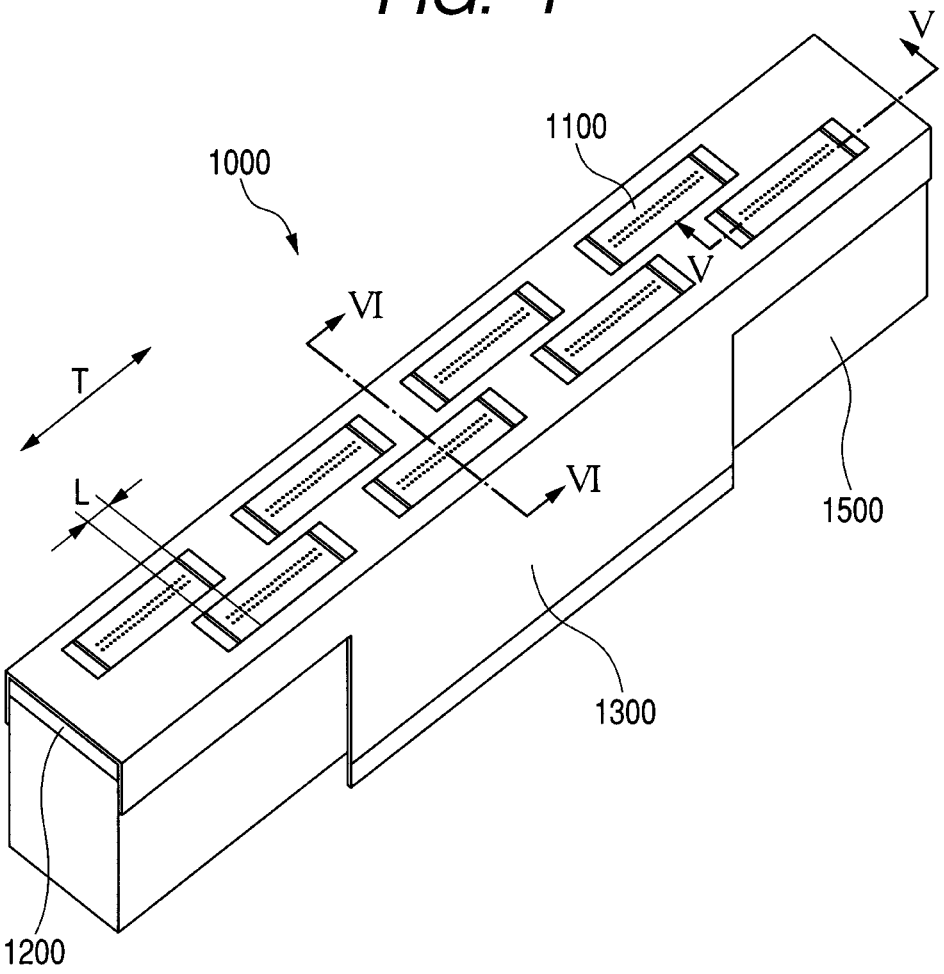
FIG. 1 is a schematic perspective view of a liquid discharge recording head relating to a first embodiment of the present invention.
Figure 2:
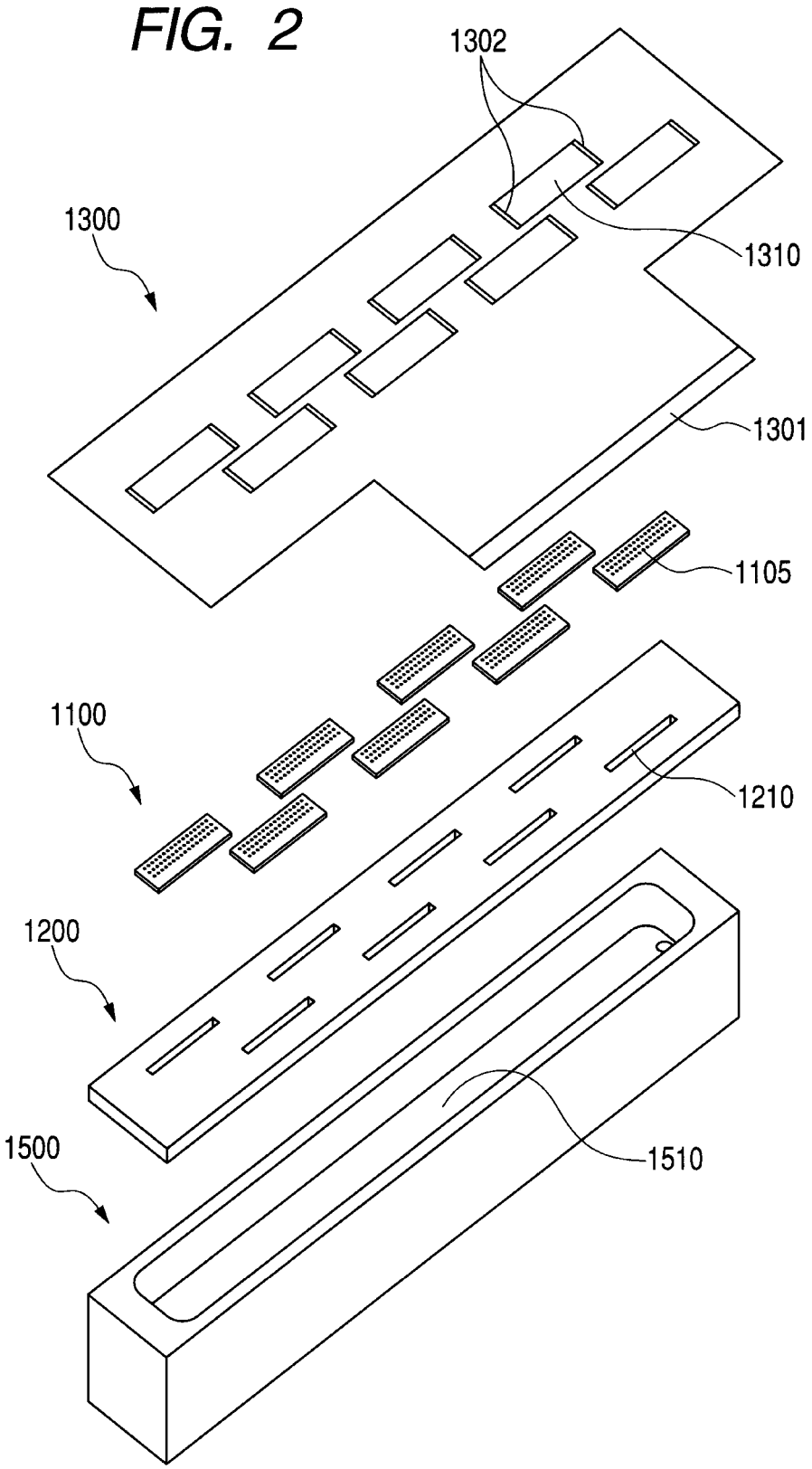
FIG. 2 is an exploded perspective view of the liquid discharge recording head illustrated in FIG. 1.

A liquid discharge recording head according to a first embodiment is described hereunder referring to FIG. 1 and FIG. 2. FIG. 1 is a schematic perspective view of a liquid discharge recording head relating to the first embodiment of the present invention. FIG. 2 is an exploded perspective view of the liquid discharge recording head shown in FIG. 1.

A liquid discharge recording head 1000 of the present embodiment includes a recording element substrate 1100, an electric wiring board 1300, a supporting plate 1200, and a liquid supplying member 1500.

Recording elements for generating energy that discharges a liquid such as ink are formed in the recording element substrate 1100. Discharge ports 1105 that correspond to the recording elements, respectively, are formed in the recording element substrate 1100. The discharge ports 1105 are arranged in a row shape. Liquid is discharged from the discharge ports 1105. The electric wiring board 1300 is provided in order to apply electrical driving signals from outside to the recording element substrate 1100. The supporting plate 1200 has liquid introduction ports 1210 that are openings for introducing liquid into the recording element substrate 1100. The supporting plate 1200 also fixedly supports the recording element substrate 1100 and the electric wiring board 1300. The liquid supplying member 1500 has a liquid supply chamber 1510 for supplying a liquid to the recording element substrate 1100.

A plurality of the recording element substrates 1100 are arranged on the supporting plate to form a full-line type liquid discharge recording head. The full-line type liquid discharge recording head has discharge ports that can discharge liquid over the total width of a recording medium. According to the present embodiment, the liquid discharge recording head 1000 that has an overall recording width of approximately four to six inches includes eight recording element substrates 1100. The recording width can be further increased by increasing the number of recording element substrates 1100. Hence, it is possible to form a liquid discharge recording head that has a recording width exceeding 12 inches.

Figure 3:
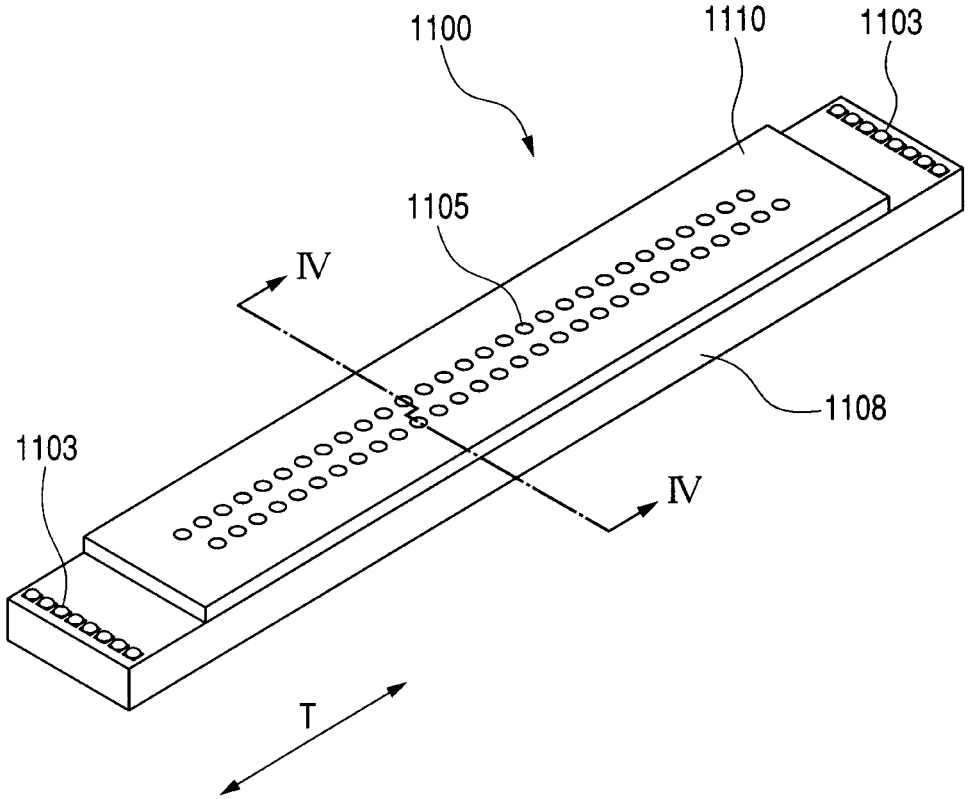
FIG. 3 is a schematic perspective view of a recording element substrate illustrated in FIG. 1.
Figure 4:
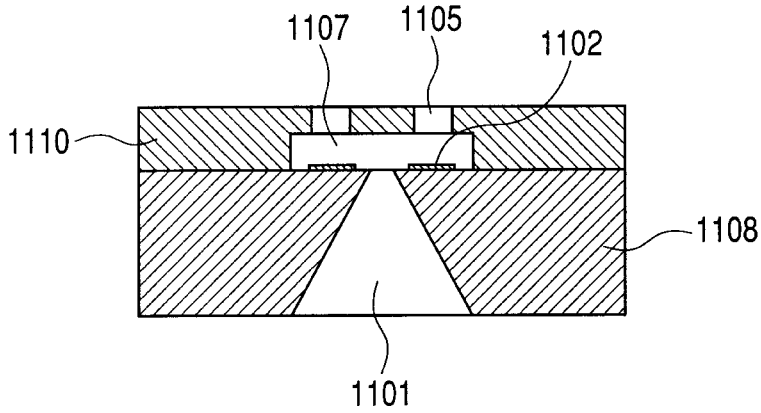
FIG. 4 is a schematic sectional view of the recording element substrate along a line IV-IV in FIG. 3.

FIG. 3 is an enlarged perspective view of the recording element substrate 1100 shown in FIG. 1. FIG. 4 is a schematic sectional view of the recording element substrate along a line IV-IV in FIG. 3. The recording element substrate 1100 has a silicon substrate 1108 that has, for example, a thickness of 0.5 to 1.0 mm, and a nozzle plate 1110. The nozzle plate 1110 is formed on the silicon substrate 1108. A liquid supply port 1101 that includes a penetration hole in the shape of long groove is formed in the silicon substrate 1108 as a liquid flow path. A bubbling chamber 1107 is formed in the nozzle plate 1110. The bubbling chamber 1107 communicates with the liquid supply port 1101 of the silicon substrate 1108.

An electricity-heat transducing element 1102 that is a recording element and electrical wiring made from, for example, aluminum (Al), are formed in the silicon substrate 1108. The electricity-heat transducing element 1102 and the electrical wiring are, for example, formed by a deposition technique. A row of the electricity-heat transducing elements 1102 is arranged on the two sides, respectively, of the liquid supply port 1101 on the silicon substrate 1108 facing the inside of the bubbling chamber 1107. The configuration is such that the electricity-heat transducing elements 1102 of one of the rows are positioned between adjacent electricity-heat transducing elements 1102 of the other row. That is, the two rows of electricity-heat transducing elements 1102 are disposed in a staggered arrangement. Discharge ports 1105 corresponding to the respective electricity-heat transducing elements 1102 are formed in the nozzle plate 1110. More specifically, the discharge ports 1105 are also disposed in a staggered arrangement. Electrodes 1103 are formed at ends on the silicon substrate 1108 of the recording element substrate 1100.

As shown in FIG. 1 and FIG. 2, the liquid discharge recording head 1000 of the present embodiment has a plurality of the recording element substrates 1100. The plurality of recording element substrates 1100 are fixed on one surface of the supporting plate 1200. The recording element substrates 1100 are disposed in two rows along a direction T in which the discharge ports 1105 are aligned. The recording element substrates 1100 are disposed in a staggered arrangement so that a recording element substrate 1100 of one row is positioned between adjacent recording element substrates 1100 of the other row. In the direction T in which the discharge ports are aligned, several discharge ports 1105 in the vicinity of the ends of the recording element substrates 1100 of one row are disposed in an overlapping manner with respect to several discharge ports 1105 in the vicinity of the ends of the recording element substrates 1100 of the other row to thereby form an overlap region L. It is thereby possible to correct a failure relating to liquid discharge that is caused by some degree of misalignment when mounting the recording element substrates 1100 on the supporting plate 1200 or a difference in discharge amounts between the recording element substrates 1100 caused by variations in the recording element substrates 1100.

Further, opening parts 1310 corresponding to the positions of the recording element substrates 1100 are formed in the electric wiring board 1300 for applying an electrical input from outside to the recording elements of the recording element substrates 1100. The recording element substrates 1100 are adhered through an adhesive 1150 to the supporting plate 1200 so as to fit in the opening parts 1310 of the electric wiring board 1300.

A gap is formed between the recording element substrates 1100 and the electric wiring board 1300. The electrodes 1103 that are formed at the ends of each recording element substrate 1100 and electrode terminals 1302 formed on the surface of the electric wiring board 1300 are electrically connected to each other by a connecting member 1303 such as wire bonding. The connecting member 1303 extends over the gap between the recording element substrate 1100 and the electric wiring board 1300.

The supporting plate 1200 is adhesively fixed to the liquid supplying member 1500 for supplying a liquid to the recording element substrate 1100. The electric wiring board 1300 is a flexible wiring board that has an external input terminal 1301 for receiving an electrical signal from outside of the liquid discharge recording head 1000. The electrical signal is, for example, sent from a liquid discharge recording apparatus to which the liquid discharge recording head 1000 is mounted. In this case, the flexible wiring board is folded and fixed so as to facilitate a connection with the liquid discharge recording apparatus.

The supporting plate 1200 is formed, for example, from aluminum oxide ($Al_2O_3$) with a thickness of 0.5 to 10 mm. The material of the supporting plate 1200 is not limited to aluminum oxide, and may be selected from other materials. Use of aluminum oxide is advantageous because it is a comparatively low cost material and offers high performance. The liquid supply chamber 1510 that serves as a flow path of liquid is formed in the liquid supplying member 1500. The liquid supplying member 1500 is, for example, formed by injection molding using a resin material.

Figure 5:
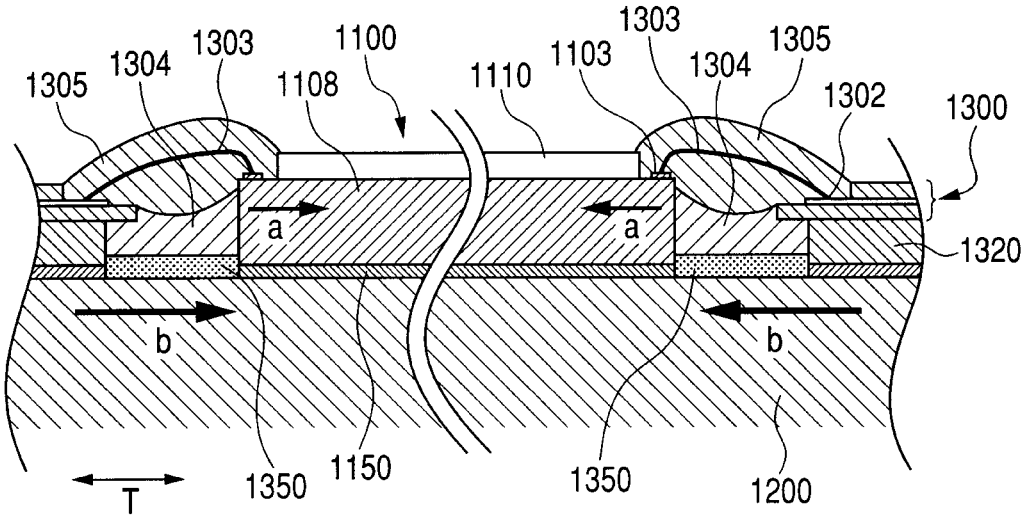
FIG. 5 is a schematic sectional view of the liquid discharge recording head along a line V-V in FIG. 1.
Figure 6:
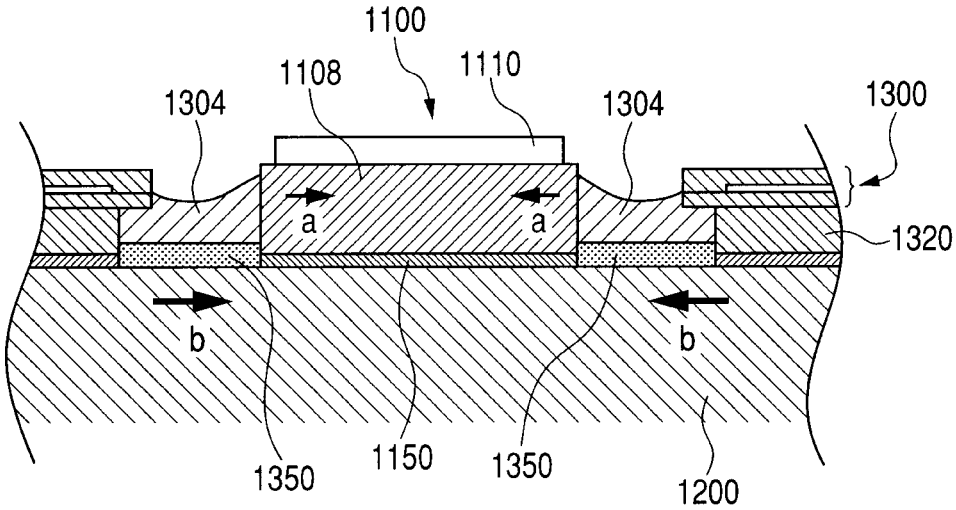
FIG. 6 is a schematic sectional view of the liquid discharge recording head along a line VI-VI in FIG. 1.

Next, one characteristic construction of the present embodiment is described using FIG. 5 and FIG. 6. FIG. 5 is a schematic sectional view of the liquid discharge recording head along the line V-V in FIG. 1. FIG. 6 is a schematic sectional view of the liquid discharge recording head along the line VI-VI in FIG. 1.

As shown in FIG. 5 and FIG. 6, the electrode 1103 that is formed in the vicinity of the end of the recording element substrate 1100 and the electrode terminal 1302 that is formed in the vicinity of the opening part of the electric wiring board 1300 are electrically connected by an electrically conductive wire as a connecting member 1303. For example, a gold wire can be used as the electrically conductive wire.

The electric wiring board 1300 is fixed to the supporting plate 1200 via a supporting board 1320. The supporting board 1320 is made from a flexible film, and is substantially integrated with the electric wiring board 1300. Since a distance between the supporting plate 1200 and the electrode terminal 1302 is increased by the supporting board 1320, the adhesive 1150 is prevented from adhering to the electrode terminal 1302 on the electric wiring board 1300 when sticking the electric wiring board 1300 to the supporting plate 1200 with adhesive. As a result, the occurrence of an electrical connection failure is suppressed.

A third resin agent 1350 is formed on the surface of the supporting plate 1200. A first resin agent 1304 is formed so as to come in contact with the surface of the third resin agent 1350. The first resin agent 1304 is filled in the gap between the recording element substrate 1100 and the electric wiring board 1300. Further, a second resin agent 1305 is formed so as to come in contact with the surface on the opposite side to the supporting plate of the first resin agent 1304. According to the present embodiment, the third resin agent 1350 is formed in a layer shape between the first resin agent 1304 and the supporting plate 1200. The second resin agent 1305 seals the electrode 1103 of the recording element substrate 1100, the electrode terminal 1302 of the electric wiring board 1300, and the connecting member 1303.

According to the present embodiment, the first resin agent 1304 and the second resin agent 1305 are made with a resin that is in a liquid state before curing, and are formed when the resin in a liquid state is cured after the resin is applied. Compared to the other resin agents, the second resin agent 1305 has a high viscosity before curing and a high shape-retaining property. That is, the second resin agent 1305 has a modulus of elasticity that is small enough for protecting the connecting member 1303, the electrode 1103 of the recording element substrate 1100, and the electrode terminal 1302 of the electric wiring board 1300. As a result, the second resin agent 1305 has a high mechanical strength, and the second resin agent 1305 protects the connecting member 1303, the electrode 1103, and the electrode terminal 1302 mechanically, and also from corrosion caused by liquid.

The viscosity of the first resin agent 1304 before thermal curing is lower than the viscosity of the second resin agent before curing. Consequently, at the time of application it is easy for the first resin agent 1304 to enter the gap between the recording element substrate 1100 and the electric wiring board 1300 (and supporting board 1320). It is therefore possible for the first resin agent 1304 to enclose the entire circumference of the recording element substrate 1100 and thereby prevent liquid that flows through the inside of the liquid discharge recording head 1000 from leaking between the recording element substrate 1100 and the supporting plate 1200.

The first resin agent 1304 includes, for example, a thermosetting epoxy resin. The second resin agent 1305 includes, for example, a thermosetting epoxy resin that is different to the first resin agent 1304. A resin with a comparatively high modulus of elasticity is used for the second resin agent 1305 so as to protect the connecting member 1303, the electrode 1103, and the electrode terminal 1302 from an external force caused by, for example, wiping or a paper jam.

The first resin agent 1304 and the second resin agent 1305 can include materials each of whose modulus of elasticity or linear expansivity is close to each other. Thus, the adhesiveness of the first resin agent 1304 and the second resin agent 1305 increases, and it is possible to prevent liquid from entering at the boundary between the first resin agent 1304 and the second resin agent 1305 and corroding an electrically connecting part.

In the process of thermally curing the resin agent and subsequently cooling the resin agent from a high temperature to ambient temperature, as described in the background art, the recording element substrate 1100 contracts in the direction indicated by arrows a in FIG. 5 and FIG. 6, and furthermore, the supporting plate 1200 contracts in the direction indicated by arrows b. When the linear expansion coefficients of the recording element substrate 1100 and the supporting plate 1200 are different, a difference arises in the deformation amount between the recording element substrate 1100 and the supporting plate 1200 due to the difference in the linear expansion coefficients.

According to the liquid discharge recording head of the present embodiment, the third resin agent 1350 that has a lower modulus of elasticity than the first resin agent 1304 and the second resin agent 1305 is formed between the supporting plate 1200 and the first resin agent 1304. Therefore, even if a difference arises between the deformation amount of the recording element substrate 1100 and the deformation amount of the supporting plate 1200, the third resin agent 1350 mitigates a force that is generated by the difference in the deformation amounts. It is therefore possible to suppress warping of the recording element substrate 1100. More specifically, since a force that is applied to the recording element substrate from the supporting plate 1200 and the surrounding resin agents is mitigated, it is difficult for an excessive amount of warping to occur.

When forming the first resin agent 1304 and the second resin agent 1305, the resin agents 1304 and 1305 are returned to ambient temperature after being thermally cured. At this time, a force is applied to the recording element substrate 1100 from the supporting plate 1200. According to the present embodiment, this force can be mitigated by the third resin agent 1350 that has a low modulus of elasticity. As a result, the recording element substrate 1100 returns to substantially the same state as when mounted on the supporting plate 1200 before the thermal curing. Accordingly, by accurately disposing the recording element substrate 1100 on one surface of the supporting plate 1200 prior to sealing using the resin agents 1304 and 1305, the recording element substrate 1100 is disposed in an exact position without warping even after manufacture of the liquid discharge recording head 1000.

As described above, a misalignment to a certain degree of the recording element substrate 1100 mounted on the supporting plate 1200 can be corrected by arranging discharge ports 1105 formed in a plurality of recording element substrates 1100 so as to overlap with each other. However, it is difficult to make such a correction when the deformation amount of the recording element substrate 1100 is large. In particular, in the case of a full-line type liquid discharge recording head that includes a plurality of recording element substrates 1100, the error accuracy that is required with respect to the relative positions of the recording element substrates is extremely high, with an accuracy of a level of several μm being required. It is therefore necessary to decrease the amount of deformation of the recording element substrates by even a small amount. Accordingly, the liquid discharge recording head of the present embodiment is favorably applied to a full-line type liquid discharge recording head in particular.

Hereunder, an example of a method of manufacturing the liquid discharge recording head 1000 of the present embodiment is described. First, the recording element substrate 1100, the electric wiring board 1300, the supporting plate 1200 that supports the recording element substrate 1100 and the electric wiring board 1300, and the three kinds of resin agents 1304, 1305, and 1350 described above are prepared.

Subsequently, the recording element substrate 1100 is joined to the supporting plate 1200, and the third resin agent 1350 is formed in a layer shape on the supporting plate 1200. Thereafter, the recording element substrate 1100 is positioned at an opening part of the electric wiring board 1300 so that a gap is formed between the recording element substrate 1100 and the electric wiring board 1300, and the electric wiring board 1300 is joined to the supporting plate 1200.

Further, the electrode 1103 provided in the recording element substrate 1100 and the electrode terminal 1302 provided in the electric wiring board 1300 are electrically connected by the connecting member 1303 that extends across the gap. Next, the first resin agent 1304 is filled into the gap between the recording element substrate 1100 and the electric wiring board 1300. Thereafter, the electrode 1103 of the recording element substrate 1100, the electrode terminal 1302 of the electric wiring board 1300, and the connecting member 1303 are sealed with the second resin agent 1305.

As another example of the manufacturing method, the third resin agent 1350 that has a small modulus of elasticity may be formed on the supporting plate 1200, and thereafter the recording element substrate 1100 and the electric wiring board 1300 may be joined to the supporting plate 1200.

As a further example of the manufacturing method, after joining either the recording element substrate 1100 or the electric wiring board 1300 to the supporting plate 1200, the third resin agent 1350 that has a small modulus of elasticity may be formed thereon.

According to the present embodiment, the electrode 1103 is formed at both ends in the longitudinal direction (direction T in which the discharge ports are aligned) of the recording element substrate 1100. The second resin agent 1305 is then formed so as to cover the electrodes 1103 (see FIG. 5). The second resin agent 1305 is not formed in an area near the edges of the recording element substrate 1100 in the direction perpendicular to the longitudinal direction of the recording element substrate 1100 (see FIG. 6). Since there is a large amount of deformation of the recording element substrate 1100 at the two ends in the longitudinal direction thereof, a decrease in reliability that accompanies warping of the recording element substrate 1100 is suppressed by the second resin agent 1305.

As shown in FIG. 6, at least one part of the first resin agent 1304 may be exposed on the surface of the liquid discharge recording head. In this case, the first resin agent 1304 can have a high modulus of elasticity in order to improve the resistance to an external force. According to the liquid discharge recording head of the present embodiment, even though the first resin agent 1304 has a high modulus of elasticity, the third resin agent 1350 that is provided on the surface of the supporting plate 1200 has a lower modulus of elasticity than the first resin agent 1304. Consequently, an external force applied to the recording element substrate 1100 from the supporting plate 1200 is decreased.

In this connection, an adhesive with a lower modulus of elasticity than the first resin agent 1304 and the second resin agent 1305 is used as the third resin agent 1350. In this case, the third resin agent 1350 is formed by coating the adhesive in a liquid state before curing, and then allowing the adhesive to cure. In addition, a resin member that is made, for example, by molding and that is not fixed to the supporting plate 1200 may be used as the third resin agent 1350. In this case, since the resin member is not fixed to the supporting plate 1200, there is an advantage that the force applied to the recording element substrate 1100 is mitigated further.

When the height from the supporting plate 1200 to the electrode 1103 of the recording element substrate 1100 or to the electrode terminal 1302 of the electric wiring board 1300 is 600 μm, the thickness of the third resin agent 1350 can be between approximately 5 and 400 μm. If the third resin agent 1350 is excessively thick, the boundary surface between the third resin agent 1350 and the first resin agent 1304 will be positioned close to the electrode 1103 and the electrode terminal 1302. By forming the third resin agent 1350 in a layer shape and providing the boundary surface with the first resin agent 1304 at a distance from the electrode 1103 and the electrode terminal 1302, the occurrence of an electrical connection failure can be suppressed even when a liquid enters between the first resin agent 1304 and the second resin agent 1305. However, the thickness of the third resin agent 1350 is not limited to the values described above, and the thickness can be set to an appropriate size according to the height of the electrical connecting parts such as the electrode 1103 and the electrode terminal 1302. Further, a distance from the boundary surface between the first and third resin agents 1304 and 1350 to the electrical connecting parts can be appropriately set so as to reduce the risk of an electrical connection failure due to entry of a liquid.

Figure 9:
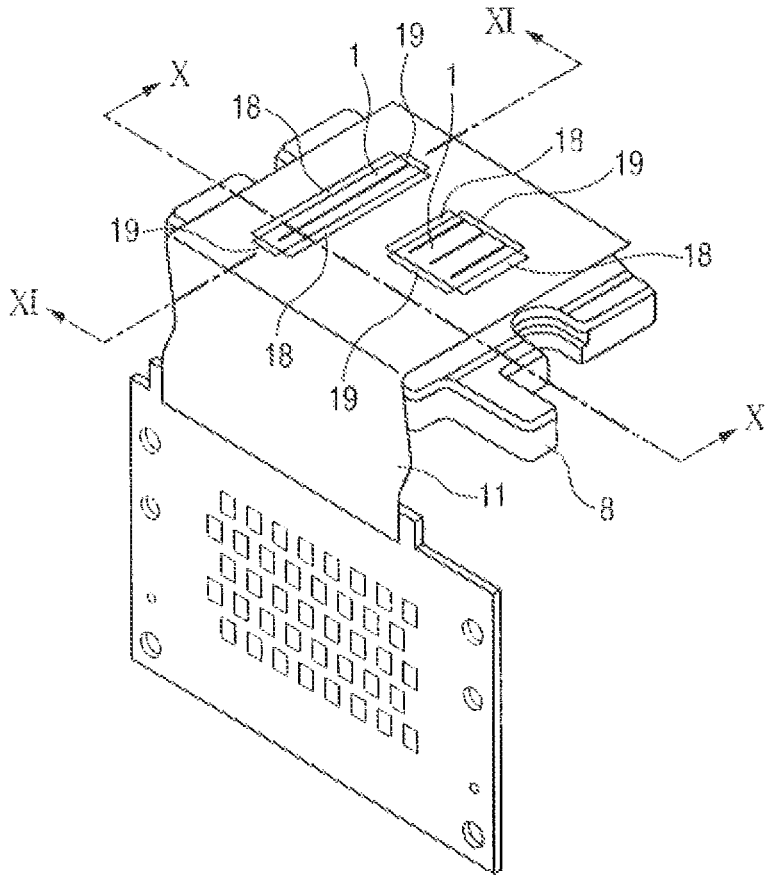
FIG. 9 PRIOR ART
FIG. 9 is a perspective view illustrating a recording element unit of a conventional liquid discharge recording head.
Figure 10:
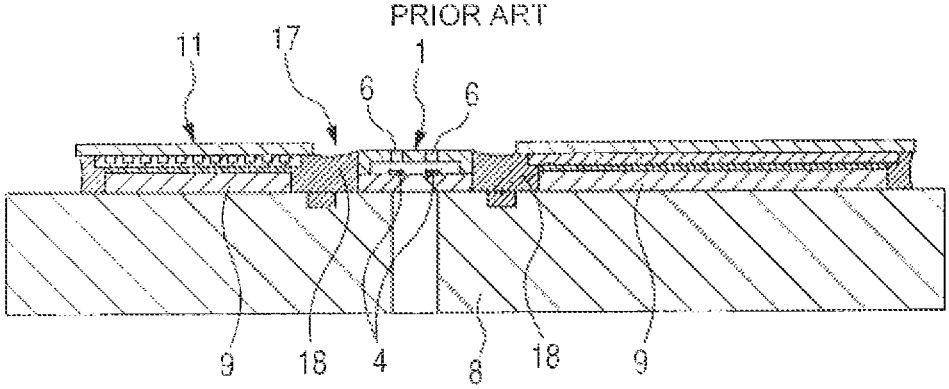
FIG. 10 PRIOR ART
FIG. 10 is a view illustrating the recording element unit of the liquid discharge recording head along a line X-X in FIG. 9.
Figure 11:
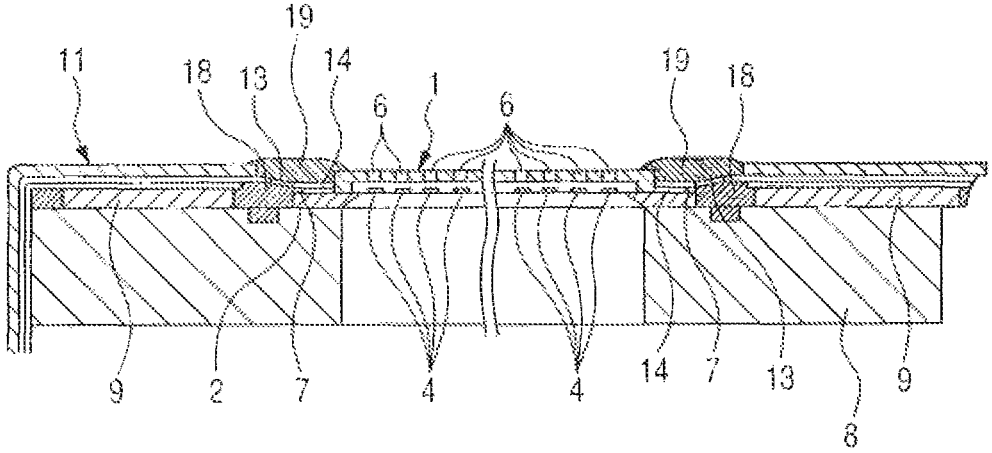
FIG. 11 PRIOR ART
FIG. 11 is a view illustrating the recording element unit of the liquid discharge recording head along a line XI-XI in FIG. 9.

Next, results of an experiment in which the liquid discharge recording head of the present embodiment and recording heads of Comparative Example 1 and Comparative Example 2 were actually manufactured and the deformation amounts of the recording element substrates were compared are shown in Table 1. The liquid discharge recording head of Comparative Example 1 is the liquid discharge recording head disclosed in Japanese Patent No. 3,592,208 illustrated in FIG. 9. The liquid discharge recording head of Comparative Example 2 is a liquid discharge recording head made by using the same resin agent for the first resin agent and second resin agent with respect to the liquid discharge head illustrated in FIG. 9. In this connection, the adhesiveness between the first resin agent and the second resin agent is described in Table 1 by taking the adhesiveness in Comparative Example 1 as a reference.

Referring to Table 1, the adhesiveness between the first resin agent and the second resin agent according to the liquid discharge recording head of the present embodiment is good compared to Comparative Example 1. Further, the deformation amount of the recording element substrate is reduced according to the liquid discharge recording head of the present embodiment compared to Comparative Example 2. Furthermore, a cationic ultraviolet curing resin is used as the third resin agent of the present embodiment.

TABLE 1

| | | COMPARATIVE EXAMPLE 1 | COMPARATIVE EXAMPLE 2 | FIRST EMBODIMENT |
|---|---|---|---|---|
| RECORDING ELEMENT SUBSTRATE | LENGTH [mm] | 24 | 24 | 24 |
| | THICKNESS [mm] | 0.625 | 0.625 | 0.625 |
| | LINEAR EXPANSIVITY [ppm] | 2.6 | 2.6 | 2.6 |
| SUPPORTING PLATE | LINEAR EXPANSIVITY [ppm] | 7.3 | 7.3 | 7.3 |
| FIRST RESIN AGENT | MATERIAL | THERMOSETTING SILICONE-MODIFIED EPOXY RESIN | THERMOSETTING EPOXY RESIN | THERMOSETTING EPOXY RESIN |
| | MODULUS OF ELASTICITY [GPa] | 0.003 | 6 | 6 |
| | LINEAR EXPANSIVITY [ppm] | 100 | 26 | 26 |
| | CURING TEMPERATURE [° C.] | 150 | 150 | 150 |
| SECOND RESIN AGENT | MATERIAL | THERMOSETTING EPOXY RESIN | THERMOSETTING EPOXY RESIN | THERMOSETTING EPOXY RESIN |
| | MODULUS OF ELASTICITY [GPa] | 9 | 9 | 9 |
| | LINEAR EXPANSIVITY [ppm] | 15 | 15 | 15 |
| | CURING TEMPERATURE [° C.] | 150 | 150 | 150 |
| THIRD RESIN AGENT | MATERIAL | NONE | NONE | UV CATIONIC (UV DELAY CURING-TYPE) EPOXY RESIN |
| | MODULUS OF ELASTICITY [GPa] | — | — | 0.07 |
| | LINEAR EXPANSIVITY [ppm] | — | — | 80 |
| DEFORMATION AMOUNT [μm] OF RECORDING ELEMENT SUBSTRATE AT AMBIENT TEMPERATURE AFTER RESIN SEALING (PLUS SIGN REPRESENTS EXPANSION, MINUS SIGN REPRESENTS CONTRACTION) | | +0.4 (n = 32 Ave.) | −1.8 (n = 8 Ave.) | −0.4 (n = 8 Ave.) |
| ADHESION BETWEEN FIRST RESIN AGENT AND SECOND RESIN AGENT | | (REFERENCE) | GOOD | GOOD |

As described above, according to the liquid discharge recording head of the present embodiment, since the amount of deformation of the recording element substrates 1100 is reduced, it is possible to maintain the arrangement of the recording element substrates 1100 with a high degree of accuracy. Thus, a decline in the printing quality can be suppressed.

It is also possible to prevent the nozzle plate 1110 and the silicon substrate 1108 that are included in the recording element substrate 1100 from separating from each other, and to prevent the recording element substrates 1100 separating from the supporting plate 1200. Resin agents that both have a high modulus of elasticity can be used as the two kinds of resin agents 1304 and 1305 provided on the third resin agent 1350 that is formed as a layer. Consequently, an effect of protecting the electrically connecting parts such as the electrode 1103 and the electrode terminal 1302 from corrosion or an external force is enhanced. It is thus possible to provide a highly reliable recording head.

Although a full-line type liquid discharge recording head is described according to the above embodiment, the present invention can also be applied to a head of a type that performs recording by a reciprocal scanning of a liquid discharge recording head.

(Second Embodiment)

Figure 7:
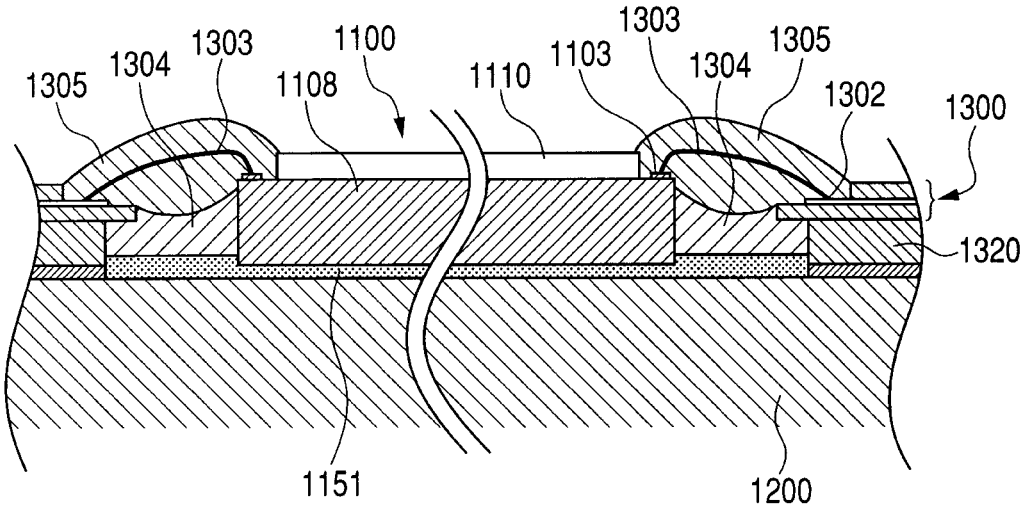
FIG. 7 is a schematic sectional view of a liquid discharge recording head relating to a second embodiment of the present invention along a line that corresponds to the line V-V in FIG. 1.
Figure 8:
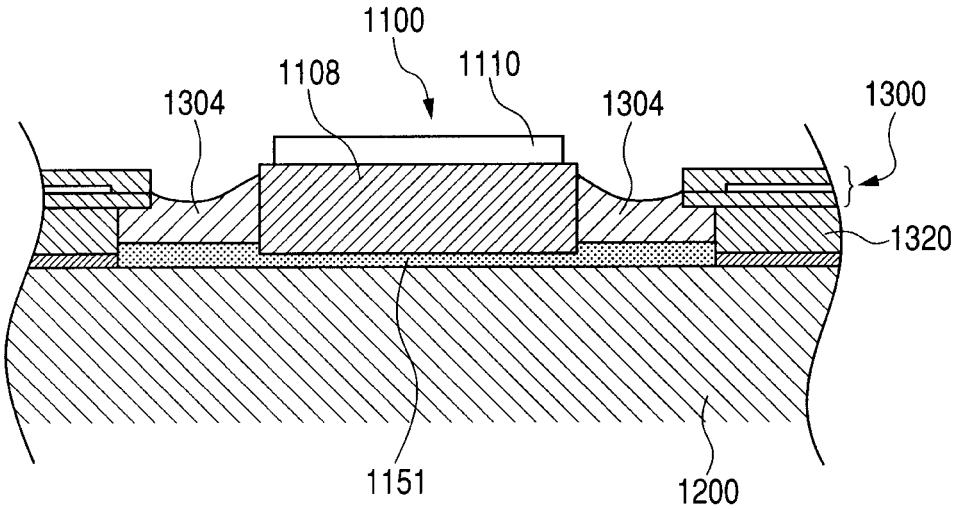
FIG. 8 is a schematic sectional view of the liquid discharge recording head relating to the second embodiment of the present invention along a line that corresponds to the line VI-VI in FIG. 1.

Next, a liquid discharge recording head according to a second embodiment of the present invention is described referring to FIG. 7 and FIG. 8. The liquid discharge recording head according to the second embodiment of the present invention has a construction that is like the construction of the liquid discharge recording head illustrated in FIG. 1. FIG. 7 is a sectional view of the liquid discharge recording head along a line corresponding to the line V-V in FIG. 1. FIG. 8 is a sectional view of the liquid discharge recording head along a line corresponding to the line VI-VI in FIG. 1. In this connection, in addition to the construction described hereunder, the liquid discharge recording head of the present embodiment may have the same construction as the liquid discharge recording head of the first embodiment.

The recording element substrate 1100 is joined to the supporting plate 1200 using a third resin agent 1151 as described in the first embodiment. That is, according to the liquid discharge recording head of the present embodiment, the third resin agent 1151 as described in the first embodiment also serves as an adhesive that fixes the recording element substrate 1100 to the supporting plate 1200. Accordingly, the adhesive that fixes the recording element substrate 1100 to the supporting plate 1200 has a lower modulus of elasticity than the first resin agent 1304 and the second resin agent 1305. In the present embodiment also, similarly to the first embodiment, the third resin agent 1151 is formed between the first resin agent 1304 and the supporting plate 1200. It is therefore possible to provide a liquid discharge recording head in which warping of the recording element substrate 1100 is suppressed, and which enables high quality printing with high reliability.

As described above, since the third resin agent 1151 as described in the first embodiment is the same as an adhesive for fixing the recording element substrate 1100 to the supporting plate 1200, the recording element substrate 1100 and the supporting plate 1200 can be formed in an integrated manner. Thus, the manufacturing process can be simplified.

According to the method of manufacturing the liquid discharge recording head of the present embodiment, first, the third resin agent 1151 is applied to the supporting plate 1200. The third resin agent 1151 is applied to a wide region so as to cover a region to which the recording element substrate 1100 is to be adhered and a region to which the first resin agent 1304 is to be applied. The recording element substrate 1100 is then adhered to the supporting plate 1200 via the third resin agent 1151. Thereafter, the electric wiring board 1300 is joined to the supporting plate 1200, the electric wiring board 1300 and the recording element substrate 1100 are electrically connected, and sealing thereof is performed with the first resin agent 1304 and the second resin agent 1305. Thus, since the adhesive provided between the first resin agent 1304 and the supporting plate 1200, and the adhesive provided between the recording element substrate 1100 and the first resin agent 1304 can be formed at the same time, the manufacturing process is simplified.

While the present invention has been described in detail above with reference to exemplary embodiments, it is to be understood that the invention is not limited to the above described embodiments. On the contrary, it is to be understood that the invention is intended to cover various modifications and alterations to a degree that does not depart from the spirit and scope of the invention.

This application claims the benefit of Japanese Patent Application No. 2009-138185, filed Jun. 9, 2009, which is hereby incorporated by reference herein in its entirety.

The invention claimed is:

1. A liquid discharge recording head, comprising:

a recording element substrate that has a recording element that generates energy for discharging a liquid, an electric wiring board that is electrically connected with the recording element of the recording element substrate and that has an opening part formed therein, and a supporting plate that supports the recording element substrate and the electric wiring board, wherein the recording element substrate is arranged at the opening part of the electric wiring board such that a gap is formed between the recording element substrate and the electric wiring board;

a connecting member that electrically connects, across the gap, an electrode provided in the recording element substrate and an electrode terminal provided in the electric wiring board; and a first resin agent that is provided in the gap between the recording element substrate and the electric wiring board, a second resin agent that seals the electrode of the recording element substrate, the electrode terminal of the electric wiring board, and the connecting member, and contacts with a surface of the first resin agent that is on an opposite side to the supporting plate, and a third resin agent that is provided between the first resin agent and the supporting plate and that has a lower modulus of elasticity than that of the first resin agent and the second resin agent, wherein the third resin agent is not fixed to the supporting plate.

2. The liquid discharge recording head according to claim 1, wherein:

the first resin agent and the second resin agent are formed by applying a resin in a liquid state, and thereafter curing the resin; and a viscosity of the first resin agent before curing is lower than a viscosity of the second resin agent.

3. The liquid discharge recording head according to claim 1, wherein at least one part of the first resin agent is exposed.

4. The liquid discharge recording head according to claim 1, wherein a linear expansion coefficient of the recording element substrate and a linear expansion coefficient of the supporting plate are different.

5. The liquid discharge recording head according to claim 4, wherein the recording element substrate comprises a silicon substrate, and the supporting plate comprises aluminum oxide.

6. The liquid discharge recording head according to claim 1, wherein the electric wiring board is a flexible wiring board.

7. The liquid discharge recording head according to claim 1, wherein the electric wiring board is supported by the supporting plate via a supporting board comprising a flexible film.

8. The liquid discharge recording head according to claim 1, wherein the first resin agent is a thermosetting epoxy resin, and the second resin agent is a thermosetting epoxy resin comprising a different material from that of the first resin agent.

9. The liquid discharge recording head according to claim 1, comprising a plurality of the recording element substrates, wherein:

discharge ports that discharge the liquid are formed in an aligned manner in rows in the recording element substrates;

the plurality of the recording element substrates are arranged in two rows on the supporting plate along a direction in which the discharge ports are aligned; and the plurality of recording element substrates are arranged such that the recording element substrates of one row are positioned between the recording element substrates that are adjacent to another row.

10. A method of manufacturing a liquid discharge recording head, comprising:

preparing a recording element substrate that has a recording element that generates energy for discharging a liquid, an electric wiring board having an opening part formed therein, a supporting plate that supports the recording element substrate and the electric wiring board, a first resin agent, a second resin agent, and a third resin agent that has a lower modulus of elasticity than that of the first resin agent and the second resin agent;

joining the recording element substrate to the supporting plate;

forming the third resin agent on the supporting plate wherein the third resin agent is not fixed to the supporting plate;

aligning the opening part of the electric wiring board and the recording element substrate so that a gap is formed between the recording element substrate and the electric wiring board, and joining the electric wiring board to the supporting plate;

electrically connecting, across the gap, an electrode provided in the recording element substrate and an electrode terminal provided in the electric wiring board by means of a connecting member;

providing the first resin agent in the gap between the recording element substrate and the electric wiring board; and sealing the electrode of the recording element substrate, the electrode terminal of the electric wiring board, and the connecting member with the second resin agent so that the second resin agent contacts with the first resin agent.

* * * * *